United States Patent [19]

Margulies

[11] 4,243,144

[45] Jan. 6, 1981

[54] BEND AND PEEL BLISTER STRIP PACKAGE

[75] Inventor: Herman Margulies, Westfield, N.J.

[73] Assignee: Sterling Drug Inc., New York, N.Y.

[21] Appl. No.: 28,398

[22] Filed: Apr. 9, 1979

[51] Int. Cl.[3] ..... B65D 83/04; B65D 85/56; B65D 75/36; B65D 75/58

[52] U.S. Cl. ..... 206/532; 206/634; 206/820

[58] Field of Search ..... 206/532, 531, 538, 539, 206/484, 564, 634, 820

[56] References Cited

U.S. PATENT DOCUMENTS

| | | | |
|---|---|---|---|
| 3,872,970 | 3/1975 | Edison | 206/532 |
| 3,921,805 | 11/1975 | Compere | 206/532 |
| 3,924,746 | 12/1975 | Haines | 206/532 |
| 3,924,747 | 12/1975 | Gerner | 206/484 |
| 3,933,245 | 1/1976 | Mullen | 206/564 |

*Primary Examiner*—William T. Dixson, Jr.
*Attorney, Agent, or Firm*—Charles R. Fay

[57] ABSTRACT

A package comprising two sheets of heat sealable material, one of the sheets being relatively stiff and being provided with cavities for dispensing a product, the other sheet covering the cavities and the stiffer sheet. The covering sheet is longitudinally perforated along at least one edge of the package a short distance inward from the edge thereof; and from the area of the perforations inwardly, terminating short of the cavities, there are unsealed areas facilitating pealing the covering sheet in the direction of the cavities giving access thereto, after releasing a portion of said covering sheet from the cavity bearing sheet by bending along the line of the perforations and peeling.

21 Claims, 5 Drawing Figures

BEND AND PEEL BLISTER STRIP PACKAGE

BACKGROUND OF THE INVENTION

Containers or packages for medicaments are desirably easily openable by an adult but not by a young child. Sometimes, however, these packages are difficult to open by adults also.

The present invention has for its main object the provision of a blister strip which is simple and easy for an adult to open, but which will baffle a child.

PRIOR ART

Among the examples of attempts to achieve a safety package of the blister strip type is U.S. Pat. No. 3,809,220, patented May 7, 1974, wherein a portion of the strip is folded, and access is thereupon provided to a notch or the like which can be used to tear the package material inwards to product containing blisters thus providing access to the contents.

Another example is U.S. Pat. No. 3,811,564, patented May 21, 1974, which is a "Bend and Peel Package" including an edge portion that may be bent to facilitate gripping a tear tab portion to provide access.

See also U.S. Pat. No. 3,924,746, patented Dec. 9, 1975, which has a thermoformed pocket in a sheet perforated between pockets and semi-circular portions which are slit to facilitate removal to allow access to the pockets.

Another patent of interest is U.S. Pat. No. 3,933,245, patented Jan. 20, 1976, which has removable facilitating means 40. This patent includes areas which are not heat sealed, to facilitate opening the package. There are many other patents which involve the concept of providing safety packages for medicaments such as tablets, caplets, capsules, etc., but as far as the applicant is aware the above cited are the closest to the present invention.

Other United States patents that may be of interest are:

U.S. Pat. No. 2,125,318—Aug. 2, 1938,
U.S. Pat. No. 2,783,877—Mar. 5, 1957,
U.S. Pat. No. 2,796,982—June 25, 1957,
U.S. Pat. No. 2,358,246—Sept. 12, 1944,
U.S. Pat. No. 3,503,493—Mar. 31, 1970,
U.S. Pat. No. 3,621,992—Nov. 23, 1971,
U.S. Pat. No. 3,630,346—Dec. 28, 1971,
U.S. Pat. No. 3,780,856—Dec. 28, 1973,
U.S. Pat. No. 3,912,081—Oct. 14, 1975.

SUMMARY OF THE INVENTION

The present invention relates to bend and peel strip packages. The strip packages contemplated by the invention are particularly useful in the packaging of medicaments, such as tablets, capsules, or the like, and since the packages of the invention require certain opening manipulations which would thwart opening by small children, they are particularly useful in the field of child resistant strip packaging.

Thus a relatively stiff sheet of heat sealable material is provided with cavities, shaped for example by thermoforming, for containing a product to be dispensed, such as tablets, capsules and the like. The stiffer sheet is covered by another relatively pliable sheet co-terminous with the cavity bearing sheet. The package is optionally provided with perforations between individual cavities for tearing off one product dispensing unit at a time, or alternatively with perforations between pairs of individual cavities for tearing off two product dispensing units at a time if desired. The cavities are located in part at one side of a center line extending through the package. There is a line of perforations through the covering sheet along an edge of the package, and in each of the sections of the strip, i.e. for each cavity, there is a non-heat sealed area between the sheets located between the perforations and each cavity. Otherwise the sheets are sealed all around the contents of the cavities and also in the area of the perforations, the non-heat sealed portions extending from the perforations inwardly but not all the way to the respective cavity.

There may be one non-heat sealed area for each cavity, or there may be an unsealed area for both of a pair of adjacent cavities. In any case, the edges of the unsealed areas are located so as to define the peeled back part of the pliable covering sheet. There are weakened lines, such as scores, slits, or perforations in the covering sheet so that when the perforated edge portion is flexed and the unsealed material is peeled back, the weakened lines facilitate the stripping of the covering sheet from the cavity bearing sheet towards the product containing cavity.

PREFERRED EMBODIMENT OF THE INVENTION

Figure 1:
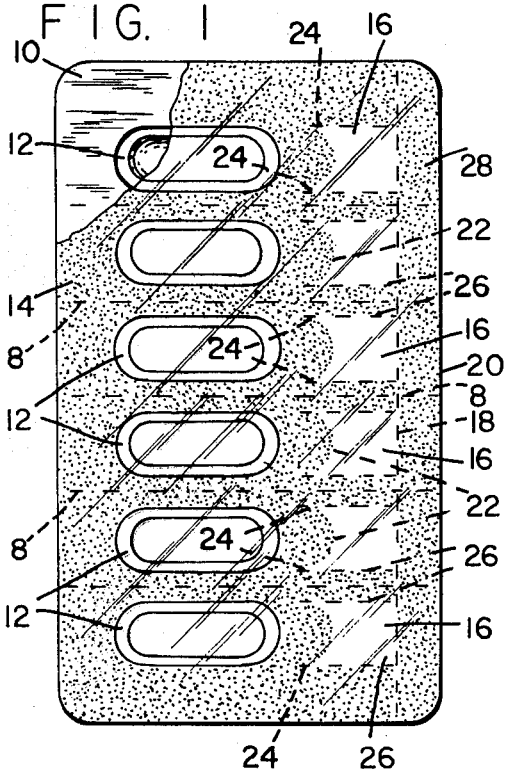
FIG. 1 is a plan view illustrating a form of the invention.

A relatively heavy sheet of heat sealable material 10 is provided with cavities, 12, produced for example by thermoforming, for dispensing a product such as capsules, tablets or the like. A second covering sheet 14 of relatively pliable material, such as Mylar, is applied to cavity bearing sheet 10 once it has received the contents of the cavities, and the two sheets are heat sealed together except at specific locations. Special reference is made to the shaded area in FIG. 1 which indicates areas of heat sealing of the covering sheet to the cavity bearing sheet, and it will be noticed that as usual the area where the capsules are located is not heat sealed, but the areas surrounding the cavities are well sealed, holding the contents in individual containers.

In this invention there are portions generally indicated at 16 which are also not heat sealed, these portions extending from a longitudinal line of perforations 18 inwardly of the edge 20 toward the cavities, the non-heat sealed areas 16 being provided with the curved edges 22,22 which essentially provide spear points or the like as indicated at 24, and these are the equivalent of slits extending the lines 26 of the unsealed areas 16 which form the side edges of the unsealed portions 16, and which define the peel back portions of the covering sheet 14. The lines 26 are weakened, as by scoring, slitting, perforating or the like, to define the peel back strips.

Figure 2:
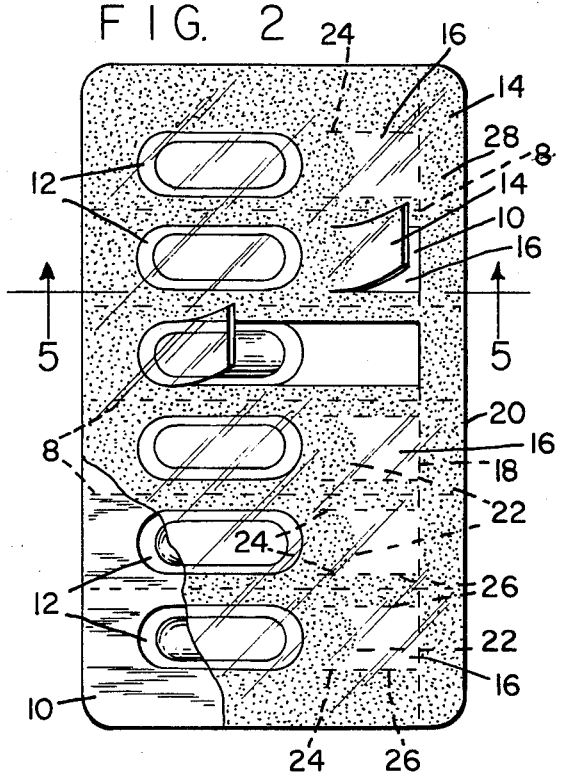
FIG. 2 is a similar view but showing the peel back action.
Figure 5:
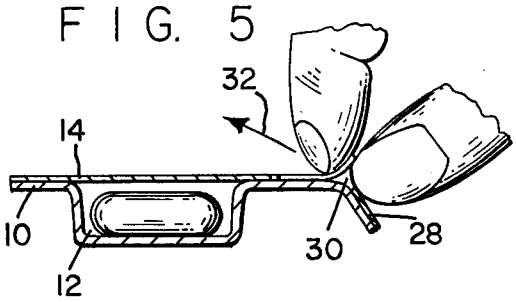
FIG. 5 is a section on line 5—5 of FIG. 2 illustrating the action of the bend and peel operation.

To the right of the line of perforations 18 in FIGS. 1 and 2, the two sheets are heat sealed together to provide a narrow flexible strip 28, such that by flexing the strip, the covering sheet may be separated along line 18 opposite a particular cavity 12. It is easy for an operator who knows the procedure to grasp the flexible strip 28 and flex it, as shown in FIG. 5, thus separating the sheets 10 and 14 as at 30. As indicated by arrow 32 in FIG. 5, by continuing this motion, the sheet 14 can be separated along perforation line 18 opposite the cavity 12 to which access is desired and then peeled back along weakened lines 26, which run into the points 24. These points at 24 serve to facilitate the peeling process more or less along straight lines in order to uncover the contents of cavity 12.

This operation will perhaps be more clearly understood by examination of FIG. 2 showing the non-heat sealed peelable areas 16 and the peel back action obtained by reason of the curved edges 22 and the pointed ends 24 thereof.

Figure 3:
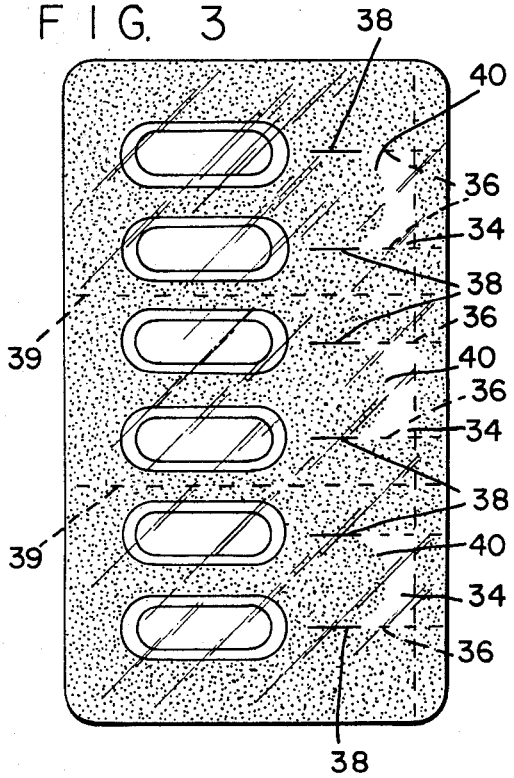
FIG. 3 is a view of a modified construction.

FIG. 3 shows a side surface of a modified blister strip where the non-heat sealed areas 34 are not located in alignment with respect to the cavities as in FIGS. 1 and 2 but instead straddle two separate cavities. The operation is substantially the same as before, but it is possible with this construction to peel the thin material 14 in the area 34 back along the edges 36 defining the non-heat sealed area, and leading into slits 38, in order to provide access to two cavities. The curved lines 40 defining the inside edge of the non-heat sealed area 34 are again provided and lead into the slits shown at 38. This construction facilitates a smooth peel back action not otherwise possible.

If desired the strip packages of the invention can be provided with perforations through both sheets 10 and 14, as indicated by 8 in FIGS. 1 and 2, to permit tearing off one product dispensing unit at a time. Alternatively, in the embodiment illustrated in FIG. 3, perforations 39 permit tearing off two product dispensing units at a time. In use one would normally first tear off a single product dispensing unit, if the embodiment represented by FIGS. 1 and 2 is used, or two product dispensing units, if the embodiment represented by FIG. 3 is used, and then obtain access to the product contained in the cavity (or cavities) by the peel back action described above.

Figure 4:
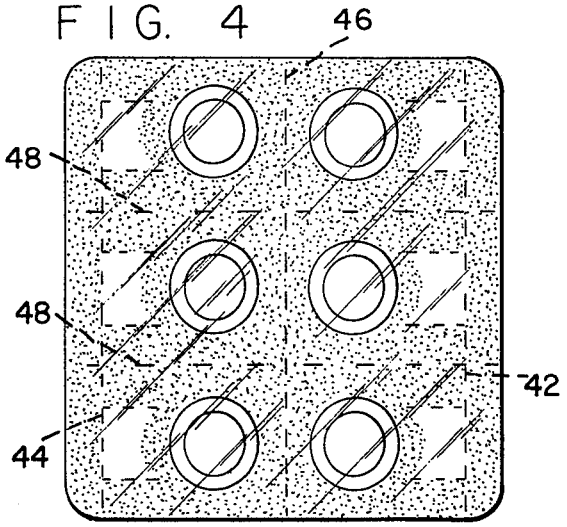
FIG. 4 is a view illustrating a package for tablets which can be arranged in rows rather than a single line.

FIG. 4 illustrates the construction of FIGS. 1 and 2 made in double rows, with a perforation line at each side as at 42, 44. A central perforation 46 and lateral perforations 48 both extending through both sheets 10 and 14 permit separation of individual product dispensing units. Otherwise the construction is as above-described.

I claim:

1. A blister strip package comprising a relatively stiff sheet, spaced cavities therein, a relatively pliable sheet heat sealed in part to the cavity bearing sheet, and being co-terminous therewith, covering the cavities, said blister strip having along an edge thereof a narrow flexible strip extending along the entire line of the cavities and capable of being flexed along a line of perforations in the covering sheet, said line of perforations defining the inside edge of said flexible strip, an unsealed area between the flexible strip and each cavity, said unsealed areas intersecting the line of perforations and having spaced edges defining lines at the sides thereof, said unsealed areas being spaced, the covering sheet being separable from the sealed flexible strip at the line of perforations to provide a pull tab in the covering sheet which is peelable towards the respective cavity along said edge defining lines, thus forming a peel strip intersecting the respective cavity and providing access thereto.

2. The blister strip of claim 1 wherein the cavity bearing and covering sheets are heat sealable plastic.

3. The blister strip of claim 1 wherein the cavities in the cavity bearing sheet are thermoformed.

4. The blister strip of claim 1 wherein each area between an unsealed area and a corresponding cavity is sealed, and includes a curved terminal edge.

5. The blister strip of claim 1 including a convex arc shaped terminal edge for each of the unsealed areas.

6. The blister strip of claim 5 wherein each terminal edge joins said edge defining lines and forms points therewith facilitating the peeling action confining the peeled strip to the general area of the respective cavity.

7. The blister strip of claim 1 wherein the edge defining lines of the unsealed areas are substantially aligned with the edges of the respective cavities, the peel strips being thereby limited substantially to the areas of the respective cavities.

8. The blister strip of claim 1 wherein the cavities are arranged in rows in pairs, there being a flex strip at each side of the blister strip with the unsealed areas between the flex strips and the cavities at both edges of the blister strip.

9. The blister strip of claim 1 wherein each unsealed area is located to straddle a pair of cavities.

10. The blister strip of claim 1 wherein said edge defining lines comprise weakened lines in the covering sheet in the unsealed areas facilitating peel back of the covering sheet.

11. The blister strip of claim 10 wherein the weakened lines are slits.

12. The blister strip of claim 10 wherein the weakened lines are scores.

13. The blister strip of claim 10 wherein the weakened lines are perforations.

14. The blister strip of claim 1 which includes perforations between the cavities to permit separation of the strip into individual units.

15. The blister strip of claim 1 which includes perforations between pairs of cavities to permit separation of the strip into pairs of units.

16. The blister strip of claim 9 which includes perforations between contiguous pairs of cavities to permit separation of the strip into pairs of units.

17. The blister strip package of claim 1 wherein the spacing of the unsealed areas conforms to the spacing of the cavities.

18. A child resistant package for medicaments comprising:

(a) a relatively stiff heat deformable plastic sheet having a row of spaced thermal formed medicament holding cavities and a narrow strip extending along an edge thereof which is parallel to said row and capable of being flexed, (b) a relatively pliable sheet heat sealed in part to the stiff sheet and being co-terminous therewith covering the cavities and medicaments in the cavities, said sheets having a plurality of unsealed areas between the cavities and the narrow strip, each unsealed area extending from said narrow strip towards the respective cavity and being spaced from the cavity, said pliable sheet having weakened edge defining lines along the sides of the unsealed areas and extending from the narrow strip towards the cavities, wherein the pliable covering sheet is broken along the inside edge of the narrow strip by flexing of the narrow strip to provide a pull tab enabling the pliable sheet to be peeled along the weakened edge lines towards the respective cavities and providing access to the medicaments therein.

19. The child resistant package of claim 18 wherein the unsealed areas are mutually spaced.

20. The child resistant package of claim 19 wherein the spacing of the unsealed areas conforms to the spacing of the cavities.

21. The child resistant package of claim 18 wherein each unsealed area straddles a pair of cavities.

* * * * *